US005334492A

United States Patent [19]

Wernicke et al.

[11] Patent Number: 5,334,492

[45] Date of Patent: Aug. 2, 1994

[54] PHOTOGRAPHIC PROCESSING METHOD AND APPARATUS

[75] Inventors: Ubbo Wernicke, Röstrath-Kleineichen; Werner Went, Leichlingen, both of Fed. Rep. of Germany

[73] Assignee: Agfa Gevaert Aktiengesellschaft, Leverkusen, Fed. Rep. of Germany

[21] Appl. No.: 896,839

[22] Filed: Jun. 11, 1992

[30] Foreign Application Priority Data

Jun. 25, 1991 [DE] Fed. Rep. of Germany ..... 4120867

[51] Int. Cl.[5] ..... G03C 5/31; G03C 5/395; G03D 3/00; G03D 3/08

[52] U.S. Cl. ..... 430/398; 430/399; 430/400; 430/450; 430/458; 430/465; 354/320; 354/324

[58] Field of Search ..... 430/398, 399, 400, 450, 430/458, 465, 466; 354/324, 320, 321

[56] References Cited

U.S. PATENT DOCUMENTS

| | | | |
|---|---|---|---|
| 2,179,242 | 1/1939 | Ham | 430/458 |
| 2,196,901 | 4/1940 | Ham | 430/465 |
| 4,804,990 | 2/1989 | Jessop | 354/324 |
| 4,977,067 | 12/1990 | Yoshikawa et al. | 430/399 |
| 5,135,840 | 8/1992 | Reuter et al. | 430/450 |
| 5,240,822 | 8/1993 | Tanaka et al. | 430/450 |
| 5,272,045 | 12/1993 | Patel et al. | 430/465 |
| 5,278,036 | 1/1994 | Kobayashi et al. | 430/465 |

FOREIGN PATENT DOCUMENTS

| | | | |
|---|---|---|---|
| 0537365 | 4/1993 | European Pat. Off. | 430/399 |
| 2541519 | 4/1976 | Fed. Rep. of Germany . | |

*Primary Examiner*—Charles L. Bowers, Jr.
*Assistant Examiner*—Mark Huff
*Attorney, Agent, or Firm*—Connolly & Hutz

[57] ABSTRACT

A method for processing photographic silver halide materials with aqueous processing baths which are replenished during processing, in which at least one chemical substance in the form of a plurality of solid bodies of geometrically defined shape and of the same size and composition is added to replenish at least one processing bath, is distinguished by a low consumption of chemicals and by a minimal accumulation of overflow for subsequent disposal.

7 Claims, 1 Drawing Sheet

PHOTOGRAPHIC PROCESSING METHOD AND APPARATUS

BACKGROUND OF THE INVENTION

This invention relates to a photographic processing method using aqueous processing baths which are replenished during processing.

FIELD OF THE INVENTION

It is known that, in photographic processes carried out by machine, the activity of the various processing baths is kept at the requisite level by replenishment.

To this end, those chemicals which are consumed by the chemical reactions of the development process are fed to the processing baths. The effect of atmospheric oxygen on reducing processing baths, such as developers and reversal baths, and the effect of carbon dioxide on alkaline baths are also neutralized by the replenishers.

The quantities in which the replenishers are used are generally proportional to the surface area of the photographic materials being processed. Like the processing baths ("working solutions") themselves, the replenishers are aqueous solutions and, to restore the activity of the working solutions, generally have a 20 to 100% higher concentration than the working solutions.

These extremely high concentrations of the replenishers are necessary in order to be able to work with low replenishment volumes and, above all in the case of baths which the material enters in already moist form, to maintain the working concentration which, in continuous operation, would otherwise be continuously reduced by the water brought in by the photographic material.

Accordingly, the dosing of the replenishers is determined by several factors at one and the same time:

chemical conversion
air oxidation
influence of $CO_2$
introduction of water or chemicals by carryover
loss of chemicals by entrainment.

DESCRIPTION OF THE PRIOR ART

In practice, dosing of the replenishing solutions leads to a number of difficulties of which some are mentioned by way of example in the following:

1. The replenishers are accommodated in containers above the processing tanks. By opening a valve, a measuring glass is filled. When the set filling level is reached, a probe is activated, closing the inlet valve and opening the outlet valve. In this widely used process, inaccurate dosing repeatedly occurs through failure of the valves or the probe. The aggressive chemicals promote the malfunction.
2. Equally widely used are diaphragm pumps of which the outputs can be adjusted by eccentric wheels, although this is complicated and inaccurate and simple air bubbles can stop the proper function of this replenishment system.
3. In order at least to rule out the effect of $CO_2$ and atmospheric oxygen on the replenishers and to eliminate this additional inaccuracy, the replenisher containers are provided with floating covers or inert gases are used or the replenishers are mixed from concentrates shortly before they are used. To this end, the various replenisher constituents, for example A, B and C, are introduced by means of small metering pumps into a mixing vessel containing a small quantity of water. This freshly mixed replenisher solution is added to the working solution. With this dosing system, however, even minor inaccuracies of the metering pumps have serious sensitometric consequences in continuous operation.

Since almost all the photographic chemicals normally used are solid and since it is undesirable to use solid powders on account of the pollution by chemical dust involved in the handling of solid chemicals, the photochemical industry has for years been producing concentrates (in some cases at considerable expense) from which the replenishers are mixed whereas, previously, the replenishers had been prepared from powder-form chemicals.

SUMMARY OF THE INVENTION

The problem addressed by the present invention was to avoid the difficulties presented by liquid replenishers without, at the same time, creating dust problems.

According to the invention, the solution to this problem is characterized in that at least one of the replenisher chemicals for replenishing a working solution is added to the working solution in the form of a plurality of solid bodies of geometrically defined shape and of the same size and composition.

In a preferred embodiment, all naturally solid processing chemicals are added to the working solution in this form, several replenishing chemicals for one and the same working solution being convertible together into a geometrically defined form of the same size and composition.

To enable dosing to be safely handled, the solid replenishes should be neither too small nor too large because, in the first case, dosing would be too laborious while, in the second case, the variations in the concentration of chemicals in the working solution would become too large.

Volumes of the individual solid bodies may advantageously be between 1 and 100 $cm^3$ and preferably between 3 and 30 $cm^3$.

Suitable geometric forms are cubes, squares, spheres, cylinders and ellipsoids of which, for example, one is always selected in the same size for a certain replenishing chemical or mixture of replenishing chemicals.

To produce the geometric forms, the solid chemicals or mixtures of chemicals are suitably press-molded in suitable machines, optionally with addition of a suitable binder. With mixtures of chemicals, all the moldings always have the same composition.

The processing apparatus is best designed in such a way that the addition of the regenerator moldings of defined shape, size and composition to the working solution is controlled in dependence upon the surface area of the material being processed, for example by the moldings being arranged one above the other and moving by gravity into a position from which they are transported into the working solution by means of an electrically operated slide or by the moldings being arranged in a line and entering the working solution by a motor-controlled transport step.

In many cases, a container smaller than and communicating with the processing tank ("balcony") is arranged on standard processing tanks at the liquid level, accommodating necessary parts of the apparatus, such as recirculation pumps, stirrers, thermometers, the inlet fort he replenisher solution, etc. The moldings are preferably introduced into this container for replenishing the processing solution.

To prevent blocking of the pump recirculation system normally present, the moldings preferably first enter a collecting basket which is situated beneath the level of the working solution in the balcony and through which the pump-recirculated working solution itself flows. On the one hand, this accelerates dissolution while, on the other hand, sudden local increases in the chemical activities of the solutions are prevented by the solid chemicals.

However, the collecting basket which the moldings enter may also be directly installed in the processing tank, preferably at a point situated at the greatest possible distance from the material to be processed.

The present invention also relates to an apparatus for processing photographic materials by means of processing solutions consisting of tanks accommodating the processing solutions and, optionally, a container ("balcony") arranged on at least one tank at the same level as the level of the processing solution in the tank and communicating with the tank, the tank comprising typical transport means for the photographic material and the balcony comprising means for pumping the processing solution through the tank/balcony system, characterized in that it is provided with means in which moldings of regenerating chemicals are arranged in a way that they can be transported one by one into the processing solution, for example vertically one above the other or horizontally adjacent one another, and means by which the moldings are transported (for example successively) into the processing solution.

The transport of the moldings may be controlled in such a way that the number of moldings entering the working solution per unit of time is the number required to keep the concentration of chemicals in the processing solution at a constant level.

Liquid processing chemicals continue to be introduced as liquids. In some cases, however, they may be processed together with solid chemicals to form solid non-tacky moldings and used in accordance with the invention.

Figure 1:
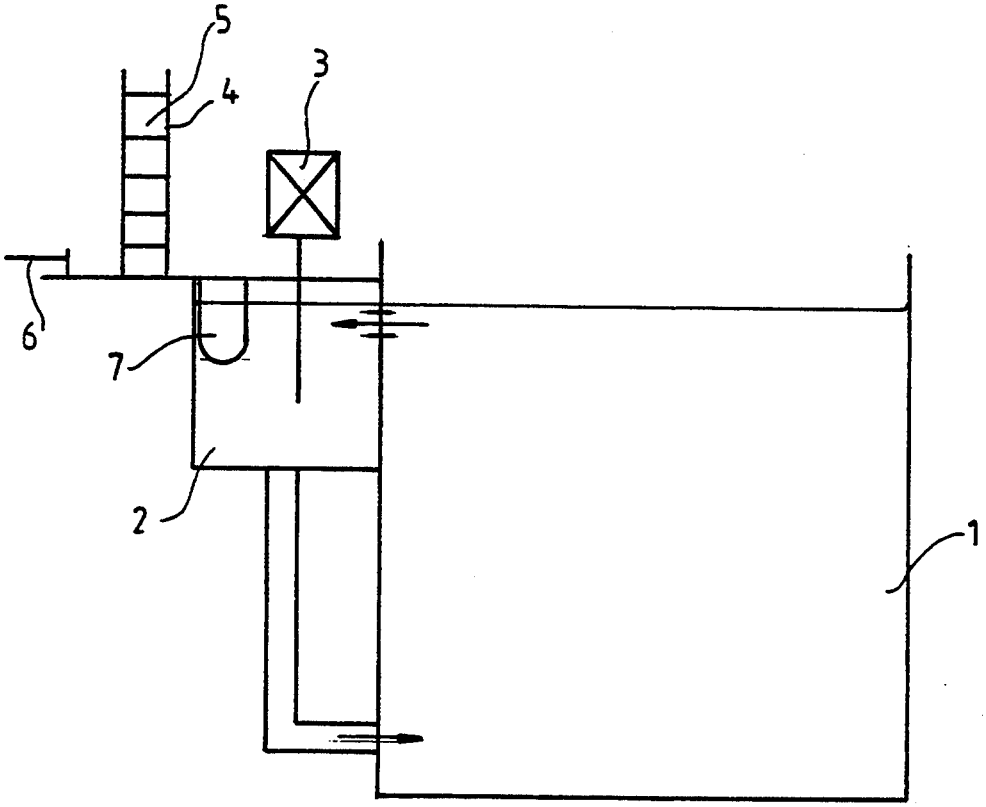
FIG. 1 schematically illustrates a suitable apparatus according to the invention.

Arranged on tank (1) containing the chemicals is another container (2 "balcony") of which the contents communicate with the contents of the tank. A pump (3) transports the contents of the tank through the balcony in the arrowed direction. Arranged on the balcony (2) is a device (4) in which moldings (5) of a photographic processing chemical or mixture of photographic processing chemicals are situated one above the other and are transported as required by transport means (6) into the basket (7) situated in the balcony.

EXAMPLE 1

A commercial color paper was processed as follows:

| | | |
|---|---|---|
| Developer | 45 secs. | 35° C. |
| Bleach-fixing bath | 45 secs. | 35° C. |
| Washing | 4 × 22.5 secs. | 25–35° C. |
| Drying | | |

1a (Comparison)

The developer was freshly prepared from the associated developer replenisher by addition of starter and water. The results are shown in the following Table.

1b (Comparison)

The procedure was as in Example 1a, except that the replenisher was left standing for 14 days after preparation. The starter was then added and processing was carried out. The results are shown in the following Table.

1c (Invention)

The constituents of the replenisher are reduced to powder, mixed and press-molded to two cubes of different chemical composition.

The replenisher cubes were left standing in the open for 14 days. They were then dissolved in water, starter was added and the solution was used to process the photographic material. The results are shown in the following Table.

It can be seen that the cubes are considerably more stable than a ready-made replenisher which normally spends a relatively long time in the replenisher storage tank because the results of 1c are nearly identical with 1a whereas 1b gives poorer results.

| | |
|---|---|
| Replenisher | |
| Color developer CD3 | 7 g |
| Sulfite | 1.5 g |
| Potash | 30 g |
| Nitrilotriacetic acid sodium (NTA) | 3 g |
| Water to 1 l | |
| Starter | |
| 30 ml containing | |
| Potash | 4 g |
| Potassium hydrogen carbonate | 6 g |
| KCl | 3 g |
| KBr | 0.02 g |
| Mixture | |
| 700 ml replenisher + | |
| 30 ml starter + | |
| water to 1,000 ml | |
| Replenisher cubes | |
| Cube A CD3 + sulfite | |
| Cube B potash + NTA | |
| Bleach-fixing bath | |
| Ammonium thiosulfate | 60 g |
| Ammonium/iron EDTA | 60 g |
| pH | 5.5 g |
| Water to 1 l. | |

TABLE 1

| | Fog | | | Gamma 1 | | | Gamma 2 | | | Maximum density | | |
|---|---|---|---|---|---|---|---|---|---|---|---|---|
| 1a | 0.11 | 0.12 | 0.12 | 1.73 | 1.70 | 1.65 | 2.80 | 3.21 | 3.25 | 2.35 | 2.38 | 2.30 |
| 1b | 0.15 | 0.15 | 0.15 | 1.69 | 1.64 | 1.64 | 2.69 | 3.14 | 3.30 | 2.24 | 2.29 | 2.31 |
| 1c | 0.12 | 0.12 | 0.13 | 1.72 | 1.69 | 1.66 | 2.81 | 3.19 | 3.26 | 2.36 | 2.40 | 2.30 |

TABLE 1-continued

| Fog | | | Gamma 1 | | | Gamma 2 | | | Maximum density | | |
|---|---|---|---|---|---|---|---|---|---|---|---|
| gb | pp | bg | gb | pp | bg | gb | pp | bg | gb | pp | bg |

gb = yellow
pp = magenta
bg = cyan

EXAMPLE 2

2a

A commercially available color paper passes through the following process in the course of photographic processing:

| | | |
|---|---|---|
| Developer | 45 secs. | 33° C. |
| Washing | 22.5 secs. | 25–35° C. |
| Bleaching bath | 45 secs. | 33° C. |
| Washing | 22.5 secs. | 25–35° C. |
| Fixing bath | 45 secs. | 33° C. |
| Washing | 45 secs. | 25–35° C. |
| Drying. | | |

The bleaching bath has the following chemical composition:

| | |
|---|---|
| Ammonium bromide | 100 g/l |
| Sodium iron EDTA | 50 g/l. |

The replenisher for the bleaching bath has twice the concentration.

The replenished rate is 60 ml/m$^2$. The tank volume of the bleaching bath tank is 5 liters.

Approx. 100 m$^2$ color paper are processed. The overflow from the bleaching bath is collected and, after approx. 100 m$^2$, the composition of the bleaching bath is determined by analysis:

| | |
|---|---|
| Ammonium bromide | 94.5 g/l |
| Sodium/iron EDTA | 46.3 g/l |

The amount of overflow was measured as 5.5 liters.

2b

The procedure was as in Example 2a, except that the replenisher was added in the form of a press-molded cube rather than in liquid form. Each cube had the following composition:

| | |
|---|---|
| 6.6 g | ammonium bromide |
| 3.4 g | sodium/iron EDTA |

90 Such cubes were added to the bleaching bath during the processing of 100 m$^2$color paper.

The composition of the bleaching bath was again determined by analysis:

| | |
|---|---|
| 102 g | ammonium bromide |
| 52 g | sodium/iron EDTA |

The amount of overflow was measured as 570 ml. The loss of liquid is compensated via the amount of water brought in by the material from the preceding washing step and carried over into the next bath (approx. 6 1/100 m$^2$)).

The amount of overflow is thus reduced to approx. 1/10.

Standard sensitometric results are obtained in both cases. Comparison of the input of chemicals in Examples 2a and 2b

| Comparison of the input of chemicals in Examples 2a and 2b: | |
|---|---|
| 2a: 100 · 60 ml = 61 bleaching bath replenisher contain | |
| 1,200 g | $NH_4Br$ |
| 600 g | NaFeEDTA |
| 2b: 90 cubes contain | |
| 594 g | $NH_4Br$ |
| 306 g | NaFeEDTA |

Accordingly, the input of chemicals was halved for the same performance.

We claim:

1. A process for processing photographic silver halide materials with aqueous processing baths which are replenished during processing comprising replenishing at least one processing bath by transporting one by one at least one replenishing chemical in the form of a plurality of solid bodies of geometrically defined shape and of the same size and composition to the processing bath.

2. A process as claimed in claim 1, wherein several chemicals together are added to a processing bath for replenishment in a geometrically defined form of the same shape and composition.

3. A process as claimed in claim 1 or 2, characterized in that the geometrically defined forms are moldings in the form of a cube, square, sphere, cylinder or ellipsoid.

4. A process as claimed in claim 3, characterized in that the moldings have a volume of 1 to 100 cm$^3$.

5. A process as claimed in claims 1 or 2 wherein the geometrically defined bodies are moldings having a volume of 1 to 100 cm$^3$.

6. A process as claimed in claim 1, wherein at least one replenishing chemical is a mixture of chemicals.

7. An apparatus for processing photographic materials with processing solution wherein said apparatus consists of: a tank accommodating the processing solution;

optionally, a container ("balcony") arranged on the tank at the same level as the processing solution in the tank and communicating with the tank, said balcony comprising means for pumping the processing solution through both the tank and the balcony;

a transport means for transporting the photographic material through the tank; and a means in which moldings of replenishing chemicals are arranged in such a manner that the moldings can be transported one-by-one into the processing solution.

* * * * *